US006286287B1

(12) United States Patent
Dieter

(10) Patent No.: US 6,286,287 B1
(45) Date of Patent: Sep. 11, 2001

(54) CONVERTED WOOD ARTICLES

(75) Inventor: Frank Dieter, Princeton (CA)

(73) Assignee: Synergy Wood Processing Inc., Vancouver (CA)

( * ) Notice: Subject to any disclaimer, the term of this patent is extended or adjusted under 35 U.S.C. 154(b) by 0 days.

(21) Appl. No.: 09/250,166

(22) Filed: Feb. 16, 1999

Related U.S. Application Data

(63) Continuation-in-part of application No. 08/805,141, filed on Feb. 24, 1997, now Pat. No. 5,870,876.

(51) Int. Cl.[7] ..... E04C 3/12; E04C 3/36

(52) U.S. Cl. ..... 52/731.2; 52/233; 52/609; 52/574; 52/730.7; 52/DIG. 8; 446/115; 446/125

(58) Field of Search ..... 52/233, 731.7, 52/731.1, 730.7, DIG. 8, 608, 609, 610, 611, 309.1, 309.15, 574, 575, 589.1, 591.1–591.3, 592.2, 596, 730.1, 731.2; 446/106, 115, 125; 144/345, 355, 360, 363

(56) References Cited

U.S. PATENT DOCUMENTS

| | | | | |
|---|---|---|---|---|
| Re. 35,327 | | 9/1996 | Sing . | |
| 4,394,409 | | 7/1983 | Hertel . | |
| 4,794,749 | * | 1/1989 | Marcel | 52/611 |
| 5,299,400 | | 4/1994 | Sing . | |

FOREIGN PATENT DOCUMENTS

| | | |
|---|---|---|
| 964637 | 5/1957 | (DE) . |
| 962589 | 6/1950 | (FR) . |
| 2512729 | 3/1983 | (FR) . |
| 2133117 | 11/1995 | (JP) . |

* cited by examiner

*Primary Examiner*—Yvonne M. Horton
(74) *Attorney, Agent, or Firm*—Hall, Priddy, Myers, & Vande Sande

(57) ABSTRACT

A converted wood article for use in combination with other converted wood articles to form composite wood products for use in general construction such as in the construction of posts, flooring, walls and support beams.

26 Claims, 6 Drawing Sheets

CONVERTED WOOD ARTICLES

RELATED APPLICATION

This application is a continuation-in-part of application Ser. No. 08/805,141 filed Feb. 24, 1997, now U.S. Pat. No. 5,870,876 issued Feb. 16, 1999.

FIELD

The present invention relates to converted wood articles and composite wood products made therefrom for use in general construction primarily but not limited to posts, flooring, walls and support beams, the posts and beams being both structural and non-structural, and a method for fabricating such articles and products.

BACKGROUND

The depletion of old growth forest has placed increasing demand within the forest industry for alternative wood products which make better use of old growth and stagnant growth timber and which also provide for greater use of second, third and later generation trees.

Several alternative wood products have emerged in an effort to address some of the needs in the industry. In this respect U.S. Pat. No. 4,394,409 discloses a composite wood product formed from four elongated triangular-shaped wood pieces. The four pieces are joined to form a composite wood product having a cross-sectional outline of a parallelogram and a hollow interior. An alternative embodiment is disclosed where each wood piece has a pair of machined keys to improve yield.

In U.S. Pat. No. 5,299,400 there is disclosed a composite wood product formed from four log parts, each log part having a three sided cross-section forming either right angled sectors and a third curved face or a right triangle. The log parts are assembled into a composite wood product so that their right angles form the corners of a rectangle with a hollow interior which is filled with concrete or other structural enhancing material, Similar examples of this alternative wood structure appear in U.S. Reissue 35,327 and French Patent No. 962589. Other attempts to offer improved composite wood products can be found in French Patent No. 2512729 and German Patent No. 964637.

While the composite wood products disclosed in the above mentioned references provide some improvements to the known art, there remains a continuing need for composite wood products providing additional resistance to shearing forces and impact forces, assembled from converted wood parts having a larger bonding surface and having a higher load bearing capacity without the preemptive need for the structural reinforcing material indicated in the prior art. Accordingly, it is an object of the invention to provide alternative converted wood articles for use in making composite wood products to fulfill the above needs in the art.

SUMMARY OF THE INVENTION

According to the invention there is provided a converted elongated wood article of triangular cross-section, having a first longitudinally extending face with rectangular steps whose step surfaces are parallel to a longitudinal extension of the article. A first set of the step surfaces are parallel to and a remaining second set of the step surfaces are perpendicular to a second elongated, planar face. The rectangular steps lie in planes which intersect between the second elongated planar face and a third longitudinally extending face and extend from the second elongated planar face to a third longitudinally extending face.

The second elongated planar face may be at a right angle to the third longitudinally extending face. Alternatively, the third longitudinally extending face may have rectangular steps extending from the second elongated face to the first elongated face. Preferably, the rectangular steps each have equal dimensions and the number of steps on the first face is at least three.

The steps of a converted elongated wood article may have substantially similar or different dimensions. In one embodiment, the number of rectangular steps on a stepped face is three. In another embodiment, at least one face having steps includes corners which lie substantially along a notional straight line.

Further included within the scope of this invention is a method of fabricating a composite wood product by gluing together at least two converted elongated wood articles of triangular cross section, each having a first longitudinally extending face with rectangular steps having step surfaces that extend longitudinally, parallel to a longitudinal extension of the converted elongate wood article. A first set of the step surfaces are parallel, and a second remaining set of the step surfaces are perpendicular to a second elongated, planar face. The steps extend to a third longitudinally extending face, wherein the rectangular steps of one of the converted elongated wood articles are joined in mating abutment to the rectangular steps of another of the converted elongated wood articles forming a joint. The joint is provided only with a sequence of a plurality of rectangular steps starting at the longitudinal edges of the article with a step portion rectangularly disposed with respect to the second elongated planar face.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAIL DESCRIPTION WITH REFERENCE TO THE DRAWINGS

Figure 1:
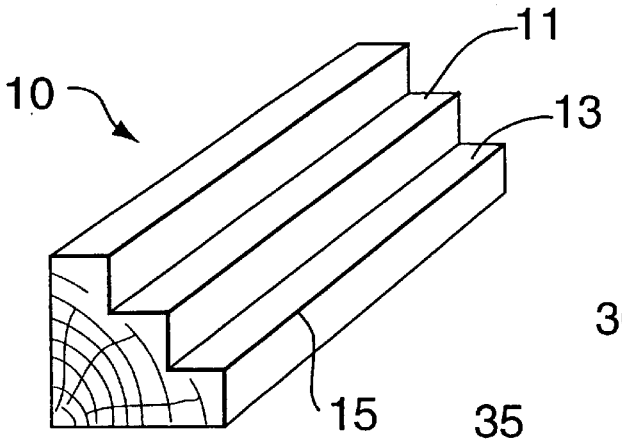
FIG. 1 is a perspective view of one converted elongated wood article having two planar faces and one stepped face.

Referring to FIG. 1, a converted elongated wood article 10 is formed according to the method set out below from a wood piece 11 and having rectangular steps 13 extending longitudinally along stepped face 15.

Figure 2:
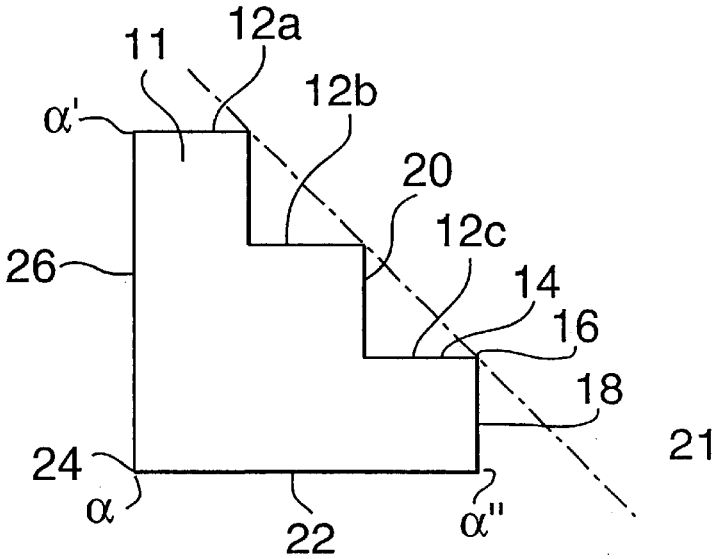
FIG. 2 is a cross-sectional view of a portion of the converted elongated wood article in FIG. 1.

Referring to FIG. 2, converted elongated wood article 10 having a triangular cross-section includes planar faces 22 and 26 and stepped face 20. Planar faces 22 and 26 intersect at region 24 forming substantially right angle $\alpha$. Stepped face 20 intersects with planar face 22 and planar face 26 forming substantially right angles $\alpha'$ and $\alpha''$, respectively. Rectangular steps 12*a*, 12*b*, and 12*c* form the outline of stepped face 20. The rectangular steps 12*a*, 12*b*, and 12*c* are comprised of a first set of step surfaces 14 and a second set of step surfaces 18 intersecting at substantially right angle corner 16. In the embodiment illustrated, steps 12*a*, 12*b*, and 12*c* are dimensioned and oriented such that each corner 16 substantially lies along a notional straight line 21.

Figure 3:
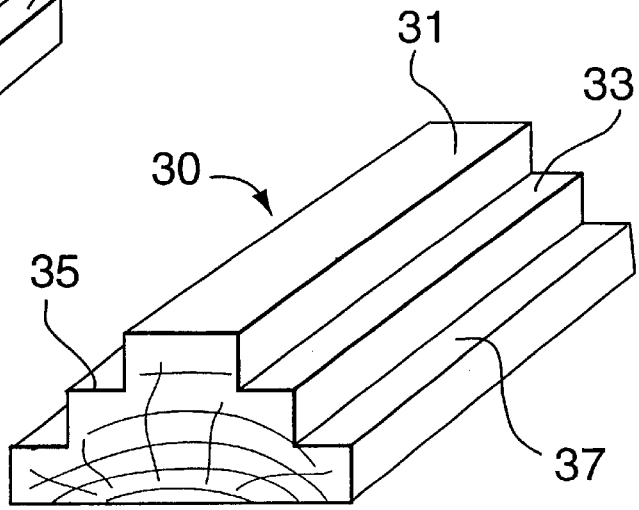
FIG. 3 is a perspective view of another converted elongated wood article having one planar face and two stepped faces.

Referring to FIG. 3, in another converted elongated wood article 30 is formed from elongated wood piece 31 having rectangular steps 37 on stepped face 33 and stepped face 35.

Figure 4A:
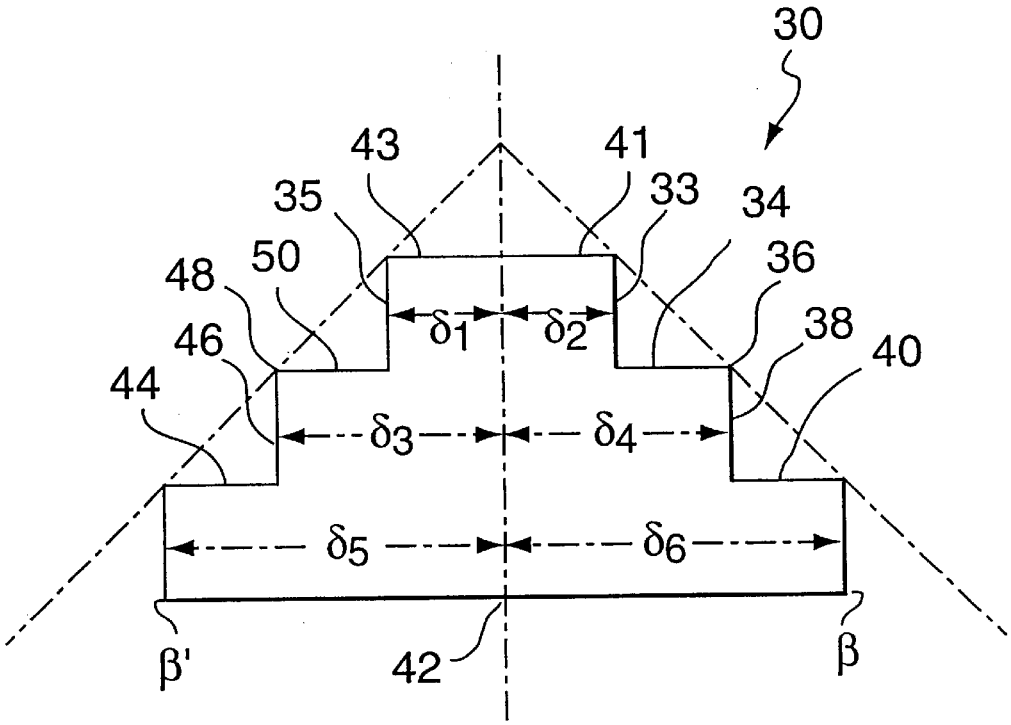
FIG. 4A is a cross-sectional view of a portion of the converted elongated wood article in FIG. 3.

Referring to FIG. 4A, converted elongated wood article 30 is shown having stepped faces 33 and 35, and planar face 42. Stepped face 33 is formed from rectangular steps 40 with each of the rectangular steps 40 having edge 34 and edge 38 which intersect at substantially right angle corner 36. Stepped face 35 is similarly formed from rectangular steps 44 each having edges 46 and 50 intersecting at substantially right angle corner 48. Each of the rectangular steps 40 and each of steps 44 after first steps 41 and 43 are successively offset from bisecting line 42. Accordingly, stepped faces 33 and 35 are arranged so that distances $\delta_1$, $\delta_3$, and $\delta_8$ from bisecting line 42 and distances $\delta_2$, $\delta_4$, and $\delta_4$ from bisecting line 42 are successively larger.

In the illustrative embodiment in FIGS. 1 and 2, converted elongated wood article 10 is formed from a log with a 100 mm diameter which has been sectioned into 1 meter long segments. Converted elongated wood article 10 has three rectangular steps on stepped face 20, each step having a height and width of approximately 15 mm. The cross-sectional length of the planar faces 22 and 26 are 45 mm each. Converted elongated wood article 30 in FIGS. 3 and 4A is cut from log 55 having a diameter of approximately 100 mm which has been sectioned into 1 meter lengths. Each rectangular step of stepped faces 33 and 35 has a height and width of 15 mm, so that planar face 42 has a length of approximately 90 mm. The above dimensions are illustrative of some of the typical converted elongated wood articles contemplated in the present invention. It will be understood, however, that the length, height and width of the converted elongated wood articles and the dimensions and number of steps will vary for selected applications. The type of wood source and dimensions of the wood source will also vary.

The converted elongated wood articles in FIGS. 1 to 4B may be used to form a large variety of composite wood products, as indicated, by way of example, in FIGS. 5 to 11.

Figure 5:
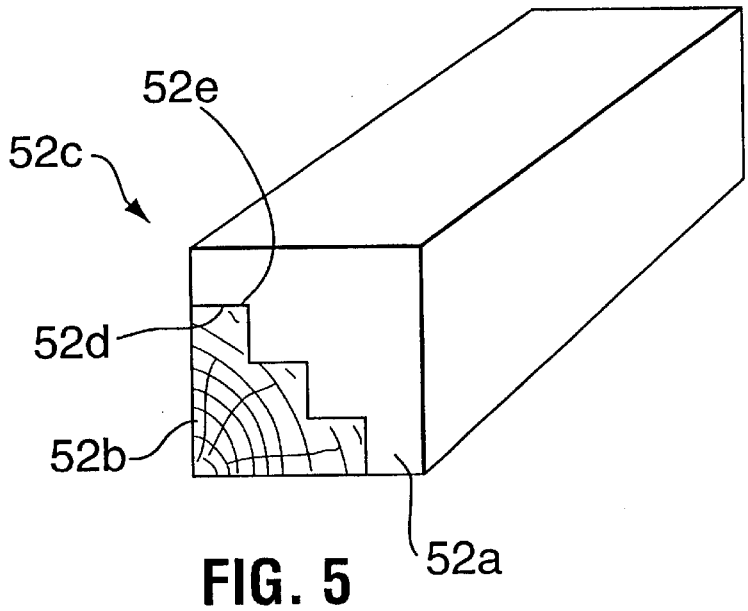
FIG. 5 is a perspective view of a composite wood product comprising converted elongated wood articles.

Referring to FIG. 5, converted elongated wood articles 52*a* and 52*b* are arranged to form composite wood product 52*c*. Stepped faces 52*d* and 52*e* of converted elongated wood articles 52*a* and 52*b* respectively are oriented inwardly and mate with each other so that composite wood product 52*c* has a rectangular cross-sectional outline.

Figure 6:
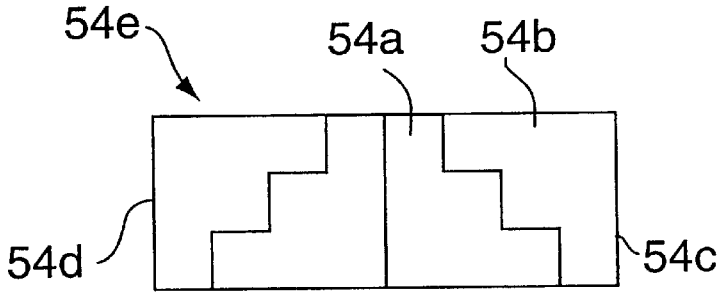
FIG. 6 is a cross-sectional view of another composite wood product comprising converted elongated wood articles.
Figure 4B:
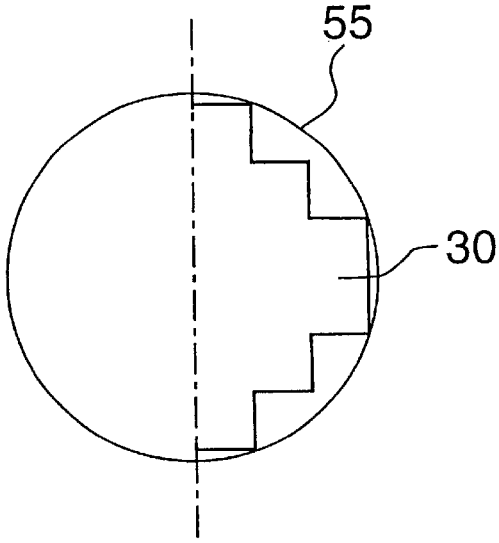
FIG. 4B is a cross-sectional view of a log and a converted elongated wood article cut therefrom.

Referring to FIG. 6, converted elongated wood articles 54*a* and 54*b* are arranged to form composite wood product 54*c* which in turn is attached to second composite wood product 54*d* to form composite wood product 54*e*. Additional composite wood products (not shown) may be attached to form larger composite wood products.

Figure 7B:
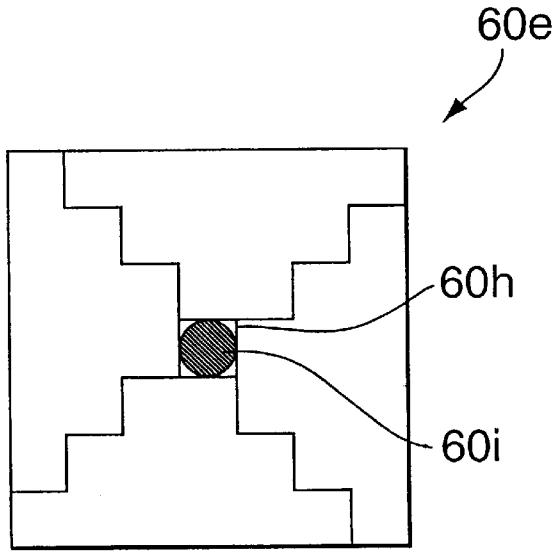
FIG. 7B is a cross-sectional view of another composite wood product.
Figure 7A:
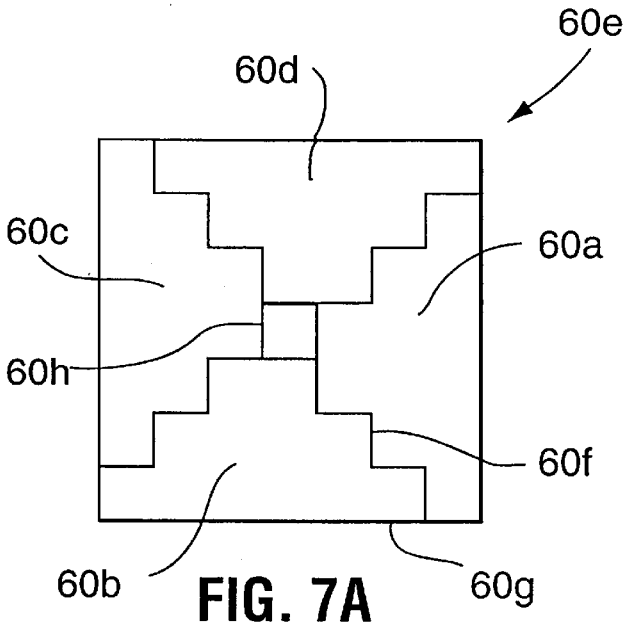
FIG. 7A is a cross-sectional view of another composite wood product.

Referring to FIG. 7A, the cross-section of another composite wood product 60*e* is shown comprising converted elongated wood articles 60*a*, 60*b*, 60*c*, and 60*d* which are of substantially similar dimension. Stepped faces 60*f* on each of the converted elongated wood articles 60*a* to 60*d* are oriented to face inwardly within composite wood product 60*e* so as to abut corresponding stepped faces of neighboring converted elongated wood articles forming hollow rectangular interior 60*h* and substantially rectangular cross-sectional outline 60*g*. Referring to FIG. 7B, composite wood product 60*e* is shown having reinforcing rod 60*i* fixed within hollow rectangular interior 60*h* to provide enhanced load bearing capacity.

Figure 8:
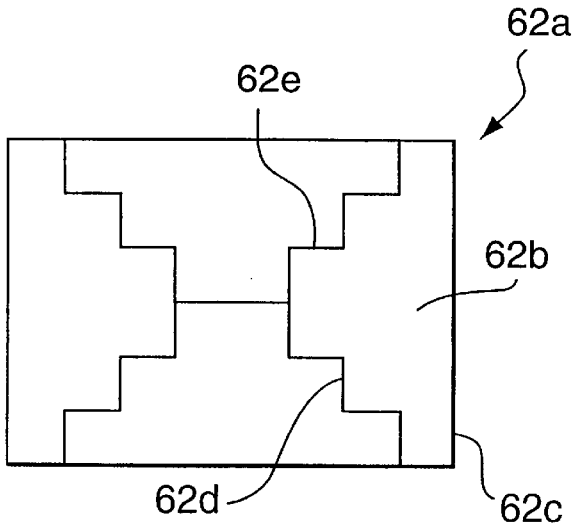
FIG. 8 is a cross-sectional view of yet another composite wood product comprising an arrangement of converted elongated wood articles.

Referring to FIG. 8, another composite wood product 62*a* is shown having rectangular cross section 62*c* and comprising converted elongated wood articles 62*b* each having stepped faces 62*d* and 62*e*.

Figure 9:
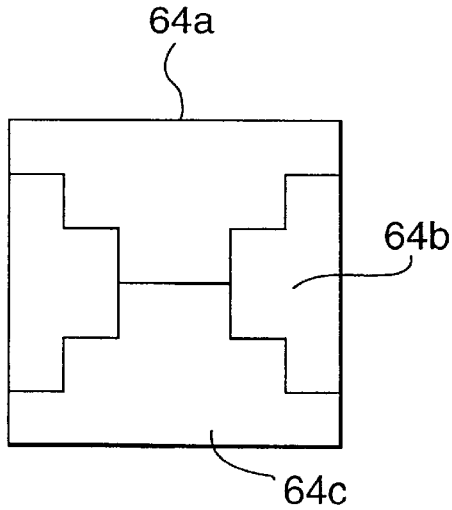
FIG. 9 is a cross-sectional view of yet another composite wood product.

Referring to FIG. 9, yet another composite wood product 64*a* is shown comprising two different sets of converted elongated wood articles contemplated herein, namely converted elongated wood articles 64*b* and converted elongated wood articles 64*c*.

Figure 10:
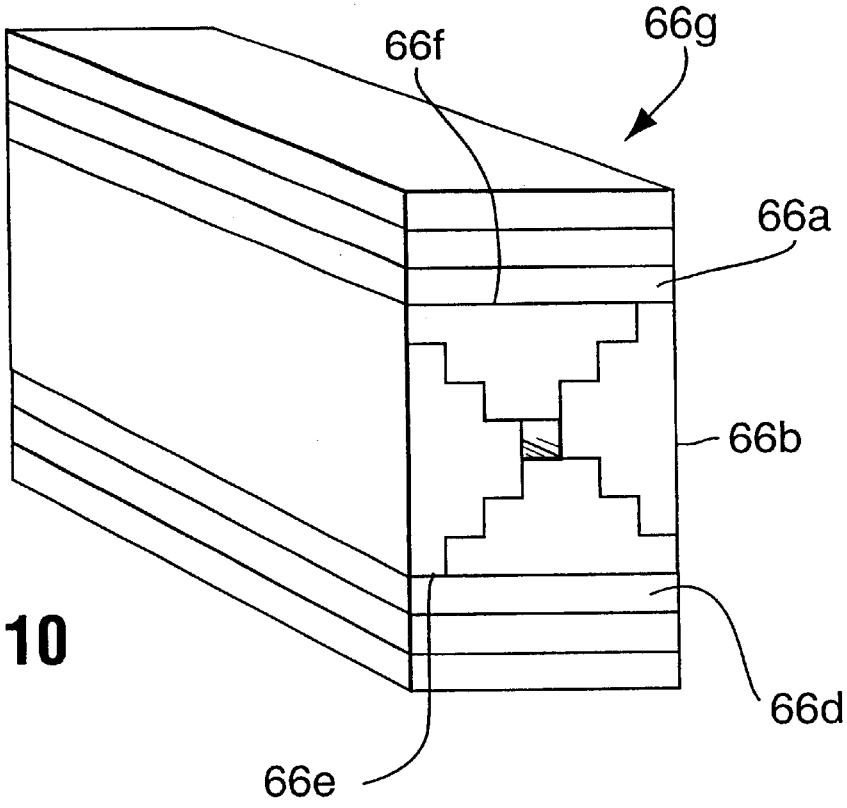
FIG. 10 is a perspective view of a composite wood product used in conjunction with other wood boards.

Referring to FIG. 10, composite wood product 66*b* is shown located between wood boards 66*a* and wood boards 66*d* which in combination form composite wood product 66*g*. Wood boards 66*a* and 66*d* are shown attached to faces 66*e* and 66*f* of composite wood product 66*b*.

Figure 11:
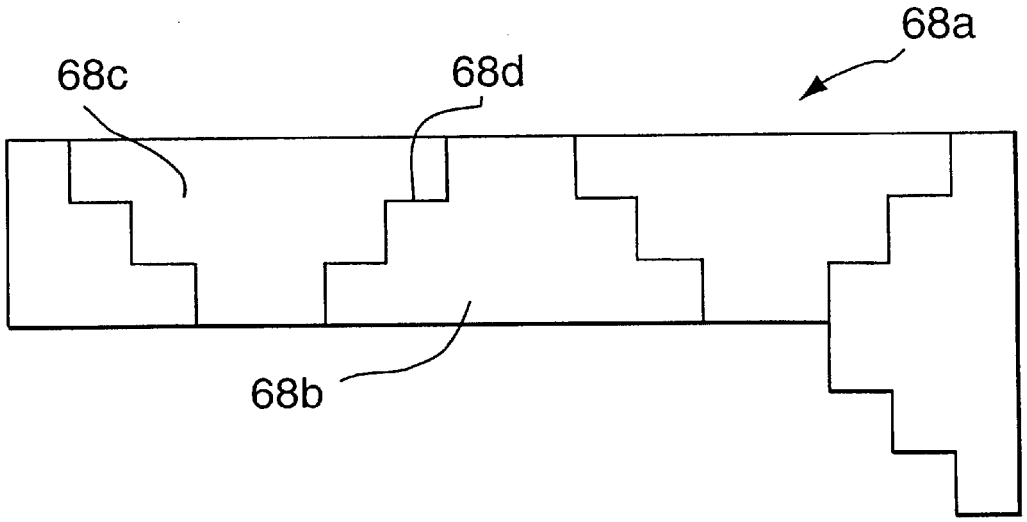
FIG. 11 is a cross-sectional view of another composite wood product under this invention.

Referring to FIG. 11, composite wood product 68*a* has converted elongated wood articles 68*b* and converted elongated wood articles 68*c* inversely arranged and joined along stepped faces 68*d*. As with the other composite wood products, the number of rectangular steps on any face of the converted elongated wood articles 68*b* and 68*c* will vary with the selected application.

Figure 12:
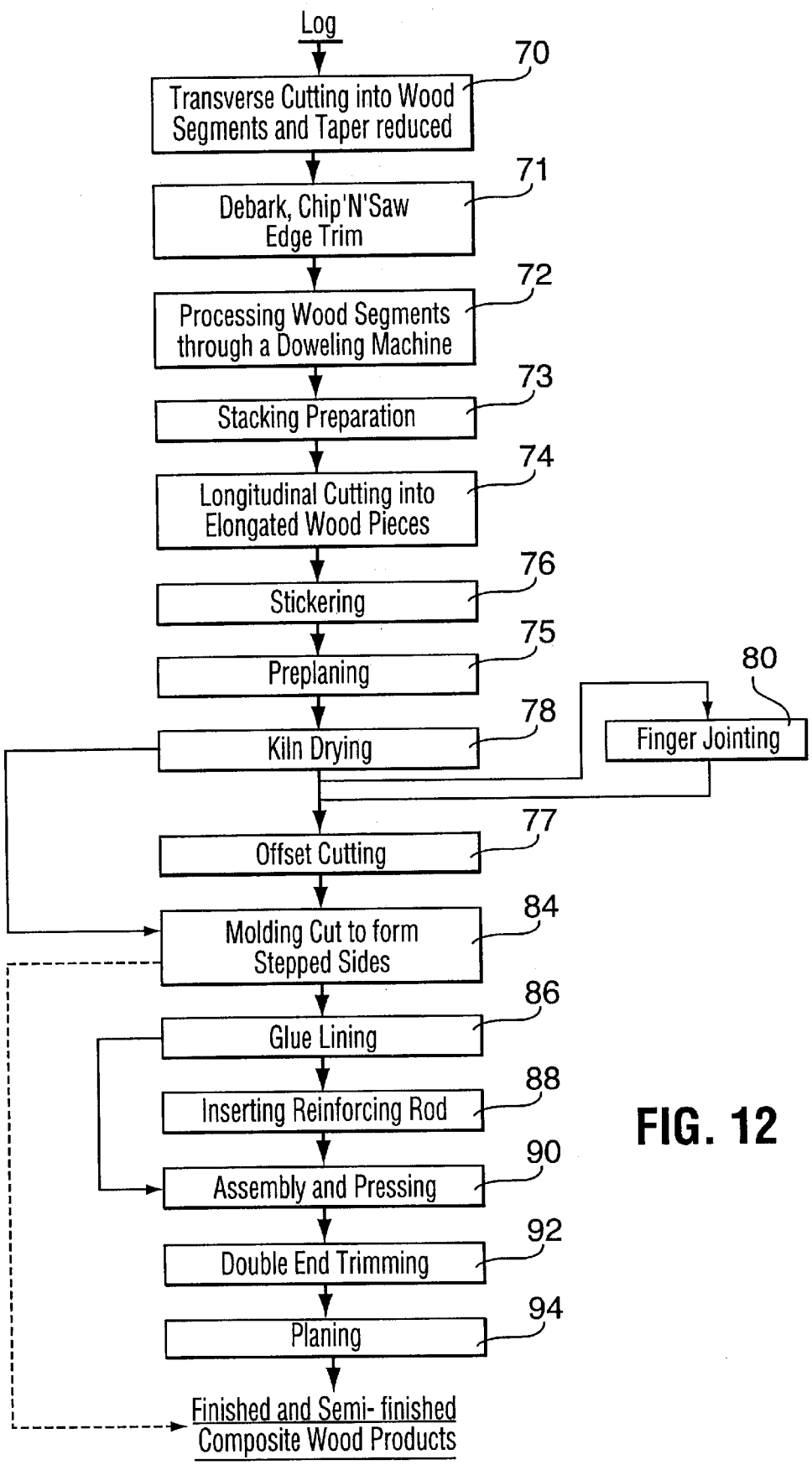
FIG. 12 is a flow diagram for the method of making converted elongated wood articles and composite wood products.

Referring to FIG. 12, one method of manufacturing the converted elongated wood articles and composite wood products made therefrom is shown. Typically elongated wood logs are used as the initial input product to be processed. At step 70 the taper of the wood product is reduced by a cutter that cuts the swollen root end down and the wood is then cut transversely into wood segments which vary in length with the desired finished or semifinished product. In one preferable embodiment, the wood segments are cut substantially into 1 meter lengths to minimize warping when kiln drying at step 78. Other segment lengths may apply depending on the drying effect of the species and the desired application. The resulting wood segments from step 70 are processed at steps 71 where they are debarked and edge trimmed and at step 72 the segments are put through a doweling machine and then undergo stacking preparation at step 73. The stacked segments are then each cut longitudinally into elongated wood pieces at step 74. The wood pieces undergo stickering at step 76, preplaning at step 75 and are then kiln dried at step 78. Alternatively, green lumber pieces may be used, which are cut transversely into wood segments at step 70, undergo stickering at step 76 followed by kiln drying at step 78.

The kiln dried wood pieces from step 78 are given a molding cut at step 84 to the form converted elongated wood articles of the type described above having either one or more stepped faces. Alternatively, kiln dried wood pieces from step 78 may be finger jointed at step 80, and given an offset cut at step 77 before undergoing the molding cut at step 84. One may also use precomposed wood products, typically laminated or solid wood boards, or wood pieces cut from solid wood boards having a wane along one or more edges in step 84 as an alternative to kiln dried wood pieces from step 78.

The converted elongated wood articles produced at step 84 may be packaged and shipped for subsequent use in assembling the composite wood products described herein.

Alternatively, the converted elongated wood articles may then undergo glue lining at step 86. Glue lining includes the application of bonding material to the surfaces of the stepped face of each converted elongated wood article. The amount and choice of bonding material applied at step 86 to the converted elongated wood articles may vary with the selected application of the final composite wood product. Preferably, the glue lining at step 86 includes application of bonding material to most or substantially all surfaces of each stepped face of the converted elongated wood article. Converted elongated wood articles are also assembled with corresponding converted elongated wood articles in step 86 to form the composite wood products described above.

Once the converted elongated wood articles have undergone glue lining and assembly at step 86 the resulting composite wood products are assembled with other corresponding wood articles and pressed at step 90. Composite wood products from step 90 are double end trimmed at step 92 and planed to final desired dimensions at step 94, resulting in semi-finished or finished composite wood products. Before undergoing pressing at step 90, composite wood products from step 86 which are arranged having a hollow interior, such as in FIG. 7B, may first have a reinforcing rod inserted into the hollow interior at step 88 to provide additional load bearing capacity and resistance to shearing and impact forces. Wood boards may also be glued and pressed to the faces of the composite wood product at step 90.

The converted elongated wood articles described herein offer substantially improved surface area on stepped faces for the application of bonding material. The stepped face or faces on each converted elongated wood article further allows for easy assembly with corresponding converted wood articles to form a wide range of composite wood products. The composite wood products formed from the converted elongated wood articles provide significant improvements in resistance to shearing and impact forces and improved load bearing capacity. The composite wood products further avoid many of the complex reinforcing requirements of the prior art. In addition, the significant resistance to shearing and impact forces achieved in the composite wood products above permits the use of wood pieces from old growth and stagnant growth timber as well as younger generation timber for a much broader application of use in the lumber industry. The composite wood products are well suited for use in making flooring, paneling, support beams, and posts, and are also well suited as substitutes to the conventional use of solid wood pieces in the construction of homes and other buildings. The scope of application for smaller wood pieces provided by the converted wood articles further results in less wood waste.

It will be obvious to one skilled in the art that while the converted elongated wood articles have one or more stepped faces, the number of steps on any stepped face will vary as required by the desired composite wood product. It will be further obvious that it is not necessary for the steps on any stepped face to lie on a notional straight line. It will be further obvious that the dimensions of each step on a stepped face need not be the same. It will be further obvious that while a reinforcing rod may be inserted during assembly of composite wood products having a hollow interior, any reinforcing material may be inserted.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A unitary converted elongated wood article, comprising: three longitudinally extending faces forming a triangular cross-section, said triangular cross-section being symmetrical about a line bisecting said triangular cross-section and wherein a first of said faces is planar and a second of said faces having rectangular steps whose step surfaces are parallel to a longitudinal extension of said unitary converted elongated wood article, wherein a first set of said step surfaces are parallel to, and a second set of said step surfaces are perpendicular to said first planar face, and said steps extending from said first planar face to a third planar face coinciding with a parallel one of said step surfaces.

2. A unitary converted elongated wood article according to claim 1, wherein a third of said faces is planar and at a right angle to said first planar face.

3. A unitary converted elongated wood article according to claim 1, wherein a third of said faces has rectangular steps whose step surfaces are parallel to a longitudinal extension of said converted elongated wood article having a first set of step surfaces parallel to, and a second set of step surfaces perpendicular to, said first planar face.

4. A unitary converted elongated wood article according to claim 3, wherein planes passing through extremities of said rectangular steps each form an equal angle with said first planar face.

5. A unitary converted elongated wood article according to claim 1, wherein said rectangular steps each have equal dimensions.

6. A unitary converted elongated wood article according to claim 1, where the number of said rectangular steps on said second face is at least three.

7. A unitary converted elongated wood article according to claim 2, wherein the number of said rectangular steps on said second face is at least three.

8. A unitary converted elongated wood article according to claim 1, wherein an extremity of each of said steps lies along a plane that does not pass through said wood article.

9. A composite wood product comprising a plurality of the converted elongated wood articles according to claim 1.

10. A composite wood product according to claim 9, wherein each said converted is an elongated beam elongated wood article dimensions to every other step.

11. A composite wood product according to claim 9, wherein each said rectangular step of each said converted elongated wood article has ubstantially similar dimensions to every other step.

12. A composite wood product comprising a plurality of the converted elongated wood articles according to claim 2.

13. A composite wood product comprising four of the converted elongated wood articles according to claim 1, wherein said four converted elongated wood articles are joined together along respective step surfaces.

14. A composite wood product according to claim 13, wherein the composite wood product has rectangular cross-section.

15. A composite wood product according to claim 14, further comprising a hollow interior space along a longitudinal direction of the composite wood product.

16. A composite wood product according to claim 15, including a reinforcing material fixed within said hollow interior space of said composite wood product.

17. A composite wood product according to claim 12, wherein said composite wood product has rectangular cross-section.

18. A composite wood product according to claim 17, wherein each converted wood article is an elongated beam.

19. A unitary converted elongated wood article to claim 3, wherein the number of said rectangular steps on said second and third faces is equal and at least three.

20. A method of fabricating a composite wood product from at least two unitary converted elongated wood articles, comprising: shaping each of said unitary converted elongated wood articles that said each article comprises three longitudinally extending faces forming a triangular cross-section which is symmetrical about a line bisecting said triangular cross-section and wherein a first of said faces is planar and a second of said faces having rectangular steps whose step surfaces are parallel to a longitudinal extension of said unitary converted elongated wood article, wherein a first set of said step surfaces is parallel to, and a second set of said step surfaces is perpendicular to said first planar face, and wherein said steps extend from said first planar face to a third planar face coinciding with a parallel one of said step surfaces and gluing together the steps of two of said each unitary converted elongated wood article, joining them in mating abutment.

21. A method according to claim 20, wherein said first and third faces are planar and perpendicular to each other.

22. A method according to claim 20, wherein the composite wood product is rectangular in cross-section.

23. A method according to claim 20, including kiln drying the wood pieces before shaping such wood pieces into converted elongated wood articles so as to remove moisture from the wood.

24. A method according to claim 20, including cutting transversely the wood pieces to form pieces having substantially one meter lengths.

25. A method according to claim 20, wherein the composite wood product has a hollow interior space.

26. A method according to claim 20, including inserting a reinforcing rod in the hollow interior space.

* * * * *

UNITED STATES PATENT AND TRADEMARK OFFICE

CERTIFICATE OF CORRECTION

PATENT NO. : 6,286,287 B1
DATED : September 11, 2001
INVENTOR(S) : Frank Dieter

It is certified that error appears in the above-identified patent and that said Letters Patent is hereby corrected as shown below:

Column 6,
Line 60, delete “is an elongated beam”.
Line 61, delete “dimensions to every other step”, and insert -- is an elongated beam --.
Line 64, delete “ubstantially”, and insert -- substantially --.

Column 8,
Line 24, delete “20”, and insert -- 25 --.

Signed and Sealed this

Ninth Day of July, 2002

*Attest:*

*Attesting Officer*

JAMES E. ROGAN
*Director of the United States Patent and Trademark Office*